US006471086B1

(12) United States Patent
Fleckenstein

(10) Patent No.: US 6,471,086 B1
(45) Date of Patent: Oct. 29, 2002

(54) PAINT TRAY

(76) Inventor: Mark Fleckenstein, 6769NFM 51, Decatur, TX (US) 76234

( * ) Notice: Subject to any disclaimer, the term of this patent is extended or adjusted under 35 U.S.C. 154(b) by 187 days.

(21) Appl. No.: 09/748,481

(22) Filed: Dec. 27, 2000

(51) Int. Cl.[7] ..... B65D 1/00
(52) U.S. Cl. ..... 220/570; 15/257.05; 15/257.06
(58) Field of Search ..... 220/570, 695, 220/702; 15/257.05, 257.06; D32/53, 53.1, 54

(56) References Cited

U.S. PATENT DOCUMENTS 3,139,188 A * 6/1964 Goetz et al. ..... 220/570 X
5,553,701 A * 9/1996 Jarecki et al. ..... 220/570 X
6,012,198 A * 1/2000 Thole ..... 220/570 X

* cited by examiner

*Primary Examiner*—Steven Pollard
(74) *Attorney, Agent, or Firm*—Lee, Mann, Smith, McWilliams, Sweeney and Ohlson

(57) ABSTRACT

A paint tray is provide for applying paint evenly onto a commercial paint roller. The paint tray includes a centralized paint well and two opposing roller ramps. The ramps include a plurality of evenly spaced, upwardly extending spikes that engage the roller nap and aid in its rotation. The paint tray also has a plurality of roller end wipers located along a right and left side of the paint tray. The end wipers remove excess paint from the ends of the roller, which aids in eliminating drips and runs on the painted surface. The paint tray also has a four outboard legs that support the paint tray off of the ground and provide for increased stability and resistance to movement when applying paint to the roller.

13 Claims, 2 Drawing Sheets

10
2
24
28
30
18
36
34
38
32
40
16
17
12
20
15
26
14
22
2
50

10
32
26
44
46
48
50
17
12
15
40

PAINT TRAY

BACKGROUND OF THE INVENTION

This invention may be described as an improved paint tray that is designed to allow for the simultaneous application of paint onto two commercial paint rollers and provides for roller edge wipers and traction spikes to aid in the proper distribution of paint onto the rollers to eliminate drips and runs on the surface to be painted.

DESCRIPTION OF RELATED ART

During the painting of large projects, commercial painters have found it advantageous to use paint rollers that are wider than the standard nine inch residential paint roller. These commercial rollers are typically twice as wide as the standard rollers. The larger rollers allow painters to cover more wall area in less amount of time. The time saved by using a larger roller equates into increased profits for the commercial painter. To accommodate the wider roller, standard paint trays have been widened. The prior art paint trays do not adequately allow the painter to evenly apply paint to the wider roller. Wet paint has a low viscosity and a low coefficient of friction. These characteristics of paint make it difficult to evenly apply paint to a roller. Instead of rotating up the ramp of the tray, the roller slides, leaving an uneven amount of paint on the roller. Also, larger rollers are harder to manipulate in the prior art paint trays, often leaving excess paint on the ends of the roller, which drips onto the floors and walls in the rooms being painted. The prior art devices do not provide for a tray that allows for the proper application of paint to the roller.

SUMMARY OF THE INVENTION

This invention may be described as a paint tray that allows for the proper application of paint onto a paint roller. The paint tray has a central paint well and two angled paint roller ramps, which allow two painters to apply paint to their rollers simultaneously with the tray positioned between the painters. The roller ramps include a plurality of traction spikes that engage the nap of the roller, forcing the roller to turn while rolled up and down the ramp. The tray includes four outboard rectangular legs that support the paint well off of the ground and distribute the weight of the tray over a smaller surface area, increasing tray stability and preventing movement. The tray also includes roller end wipers, which are positioned along the sides of the tray. The wipers effectively engage and wipe the ends of the paint roller to remove excess paint.

DETAILED DESCRIPTION OF THE INVENTION

While the present invention will be described fully hereinafter with reference to the accompanying drawings, in which a particular embodiment is shown, it is understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
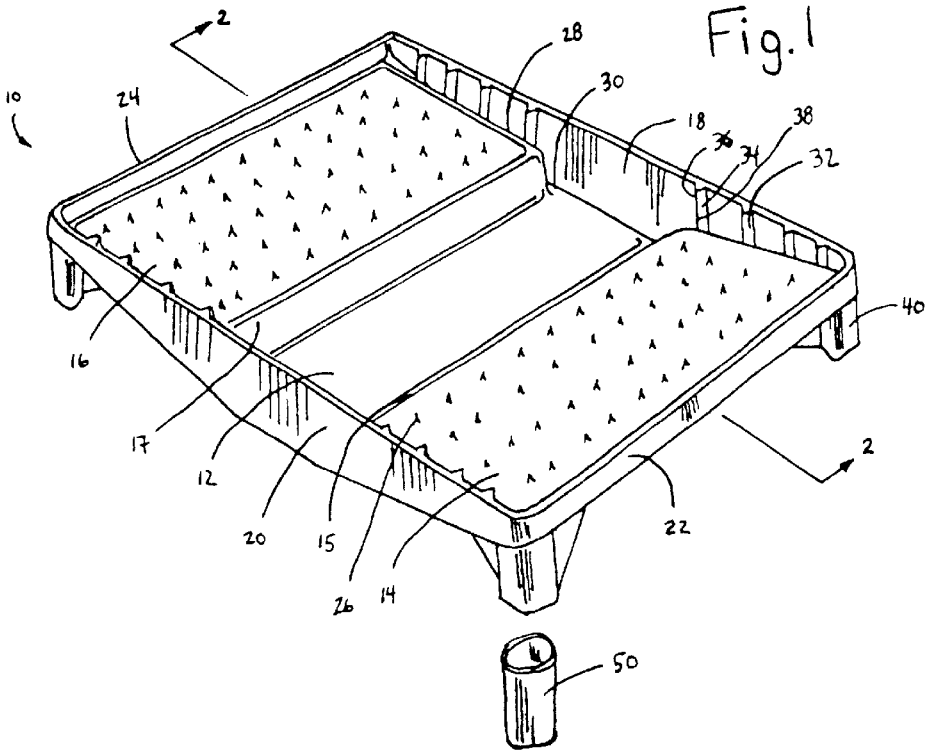
FIG. 1 is a perspective view of the paint tray of the present invention.

A preferred embodiment of the paint tray 10 of the present invention is shown in FIG. 1. The paint tray 10 is rectangular in shape and includes a paint well 12 and first and second angularly inclined roller ramps 14 and 16. The roller ramps 14 and 16 have inner edges 15 and 17 respectively that drop off into the paint well 12. The paint well 12 is located at the center of the paint tray 10 and is designed to act as a reservoir and to allow paint to be placed therein for dipping a paint roller (not shown). The paint tray 10 is preferably fabricated out of molded plastic but other materials can be used. The preferred width for the tray 10 is eighteen inches, which is the width of commercial paint rollers but can be sized to accommodate alternative sizes. The tray 10 includes a right side wall 18 and a spaced apart left side wall 20. The paint well 12 is rectangular in shape and is defined by the right side wall 18 and left side wall 20 of the paint tray 10 as well as the bottom edges 15 and 17 of the roller ramps 14 and 16. The paint well 12 is dimensioned to hold a large quantity of paint, as for example half a gallon, so the well 12 can be filled less frequently.

Figure 3:
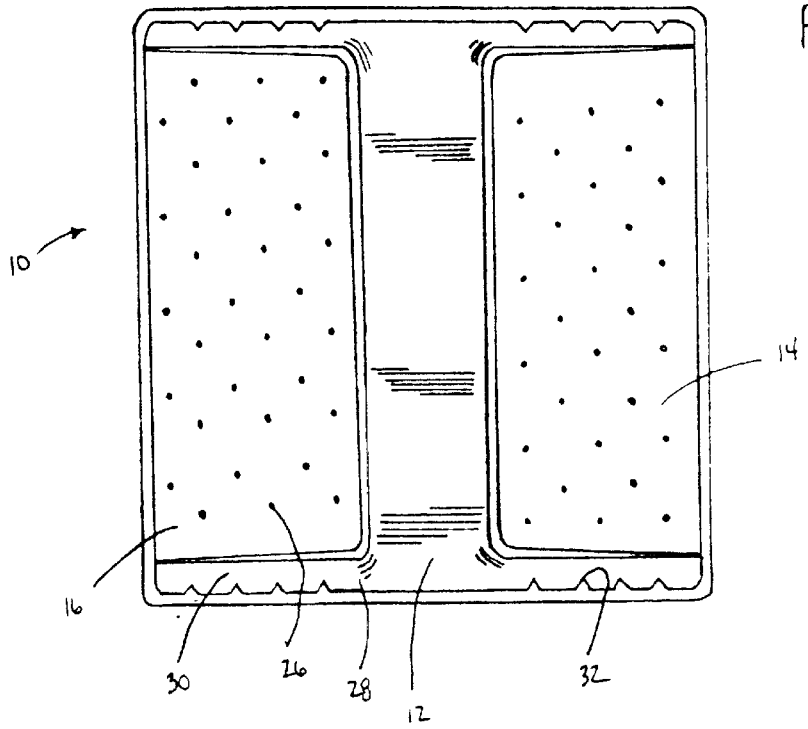
FIG. 3 is a top view of the paint tray.

The first and second roller ramps 14 and 16 are located on opposing sides of the paint well 12 and provide a surface for evenly applying the paint to the roller. The roller ramps 14 and 16 are sloped upward as they approach a front side 22 and a rear side 24 of the tray 10. The roller ramps 14 and 16 are designed so that excess paint squeezed from the roller can drain back into the paint well 12. The ramps 14 and 16 include a plurality of evenly spaced traction spikes 26. During the normal use of a paint tray, the roller ramp becomes covered with wet paint. When the paint roller is dipped into the paint well, paint is only applied to one half of the roller. The paint on the roller is evened out by rolling it up and down the ramp. Due to the inherent nature of paint, the roller ramp becomes slippery, preventing the paint roller from rotating on the ramp. Also, the paint on one side of the roller creates an uneven weight balance, discouraging full rotation of the roller on the ramp. The traction spikes 26 of the present invention aid in the rotation of the roller as it moves up the ramp. The traction spikes 26 are vertical extending points that are designed to engage the nap of the roller, allowing the roller to freely move up and down the ramp. By using spikes 26 to engage the nap of the roller, even paint coverage on the roller is possible. It is not necessary the that the spikes be painted but any configuration of projection that will engage the nap of the roller and cause it to rotate, rather than slide, as it moves up and down the ramp will be sufficient for purposes of the present invention. On the outside edges 28 of the roller ramps 14 and 16 are drainage channels 30, shown best in FIG. 3, positioned between the side wall and the side edge of the ramp, that allow paint from the edges of the rollers to drain back to the paint well 12 without accumulating near the ends of the roller.

The right and left side walls 18 and 20 of the paint tray 10 include a plurality of roller end wipers 32 that are used to engage the roller ends and wipe excess paint off of the ends of the roller. Commercial rollers hold more paint than non-commercial rollers. The paint, when applied to the roller, has a tendency to migrate towards the ends of the roller as it is moved up and down the ramps 14 and 16. This additional paint at the ends of the roller can cause drips and runs on the painting surface, leaving an undesirable finish. The end wipers 32 alleviate this problem by wiping the ends of the roller as it is rolled up and down the ramps 14 and 16. The end wipers 32 are illustrated as being triangular shaped and have a front side 34, a rear side 36 and a wiping edge 38. While the triangular shape is preferred, other shapes can be used. The wiping action is created by the wiping edge engaging the edge of the roller. The paint is essentially scraped off of the end of the roller by the wiping edge 38 onto the sides 34 and 36 of the end wipers 32 where it flows downwardly into the drain back channel 30. The end wipers 32 are molded out of the same material as the tray but can also be manufactured out of separate rubber strips (not shown). The rubber strips include a tongue (not shown) that can be inserted into grooves (not shown) on the sides 18 and 20 of the tray 10. The use of end wipers 32 has virtually eliminated the problem of paint drips caused by excess paint build up at the ends of the roller. Preferably four end wipers 32 are used on each side of each roller tray but other combinations can be used. The end wipers 32 also have the added benefit of acting as structural ribbing to reduce flexing in the tray 10 when the tray 10 is moved to a new location.

Figure 2:
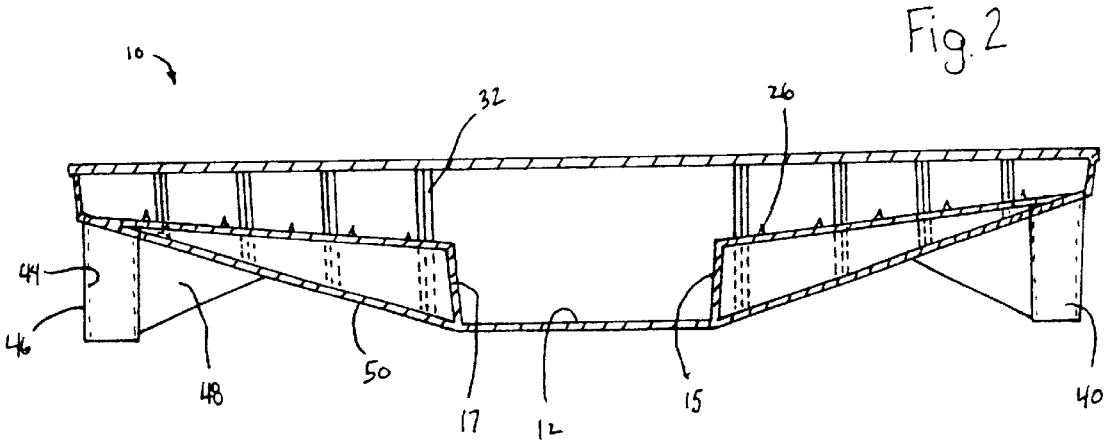
FIG. 2 is a cross-sectional view of FIG. 1.
Figure 4:
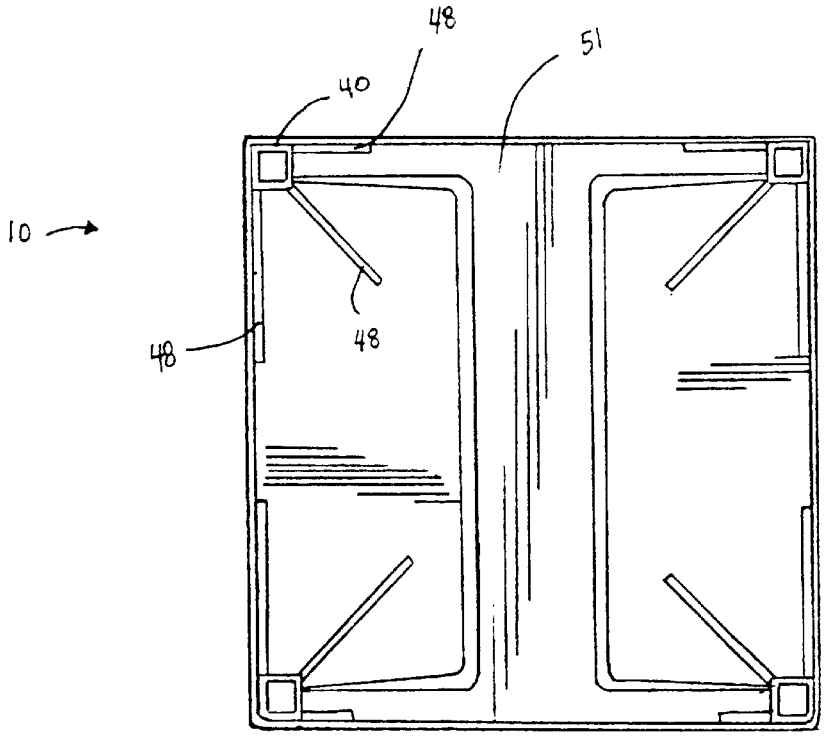
FIG. 4 is a bottom view of the paint tray.

The paint tray 10 also has four outboard leg supports 40, one located at each corner of the tray as shown in FIGS. 2 and 4, that are used to support legs 50, as shown in FIG. 1, to elevate the entire tray off of the ground or other support surface. By raising the entire tray 10 off of the ground, the weight of the tray 10 is evenly distributed over the four legs 50. Since the legs 50 have a smaller surface area than the bottom of the paint well 12, the force per unit of surface area exerted onto the ground is increased. This increase in force aids in preventing the tray from moving when the roller is rolled up and down the ramps 14 and 16. Since the legs 50 are hollow, this force is further increased. The leg supports 40 have an inner surface 44 and an outer surface 46. The legs 50 rest in the leg supports 40 on an underside 51 of the tray 10. The leg supports 40 surround an outer surface 56 of the legs 50 to provide stability. The leg supports 40 are further stabilized by use of triangular shaped braces 48 that connect the outside surface 46 of the legs 40 to the underside 50 of the paint tray 10. The braces 48 stabilize the legs 40 to prevent unwanted movement. The braces 48 also increase the strength of the paint tray 10 and provide a reduction in flexing. There are three braces 48 per leg support 40. To raise the paint tray 10 further off of the ground, longer legs 50 can be inserted into and connected with the inner surface 44 of the leg supports 40.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A paint tray for use with a paint roller comprising:

a central paint well adapted to contain paint;

a first inclined roller ramp extending outwardly and upwardly from said paint well;

a second inclined roller ramp, opposing said first roller ramp, extending outwardly and upwardly from said paint well;

a plurality of traction spikes extending upwardly from at least one of said ramps for engagement with the roller;

a plurality of wipers extending inwardly along a first side and a second side of said paint tray, said wipers adapted to engage the ends of the roller;

whereby said paint tray allows for a proper application of paint to the roller.

2. The paint tray of claim 1, wherein said wipers are fabricated out of the same material as said tray.

3. The paint tray of claim 1, wherein said wipers are fabricated out of a rubber material.

4. The paint tray of claim 1, wherein said tray includes leg supports to support said well off of the ground.

5. The paint tray of claim 4, wherein said leg supports include a plurality of braces to stabilize said leg supports.

6. The paint tray of claim 5, wherein said leg supports are adapted to accept legs to raise said tray off of the ground.

7. A paint tray as in claim 1 including first and second side walls and a paint channel defined between said roller ramp and one of said side walls, said channel operative to allow paint removed from a roller end to flow back to said central paint well.

8. A paint tray for use with a roller comprising:

a paint well adapted for containing paint;

at least one roller ramp extending outwardly and upwardly from said paint well;

first and second drainage channels positioned one each side of said roller ramp to allow for the drainage of paint;

said roller ramp includes a plurality of traction spikes adapted to engage the roller.

9. A paint tray for use with a roller comprising:

a paint well adapted for containing paint;

at least one roller ramp extending outwardly and upwardly from said paint well;

a plurality of wipers extending inwardly along a first side and a second side of said paint tray, said wipers adapted to engage a first and a second end of the roller to squeeze excess paint therefrom.

10. The paint tray of claim 9, wherein said at least one roller ramp includes a plurality of traction spikes adapted to engage the roller.

11. The paint tray of claim 9, wherein said tray includes a leg support at each comer of said tray.

12. The paint tray of claim 9, wherein said wipers are fabricated out of the same material as the tray.

13. The paint tray of claim 9, wherein said wipers are fabricated out of rubber.

* * * * *